US007549930B2

(12) United States Patent
Rice

(10) Patent No.: US 7,549,930 B2
(45) Date of Patent: Jun. 23, 2009

(54) PUTTING PRACTICE BALL AND DEVICE

(76) Inventor: Richard Patrick Butler Rice, 64 Cotswold Drive, Saxonwold, 2196 (ZA)

( * ) Notice: Subject to any disclaimer, the term of this patent is extended or adjusted under 35 U.S.C. 154(b) by 7 days.

(21) Appl. No.: 10/570,096

(22) PCT Filed: Sep. 3, 2004

(86) PCT No.: PCT/IB2004/002860

§ 371 (c)(1),
(2), (4) Date: Dec. 15, 2006

(87) PCT Pub. No.: WO2005/021101

PCT Pub. Date: Mar. 10, 2005

(65) Prior Publication Data

US 2007/0093308 A1 Apr. 26, 2007

(30) Foreign Application Priority Data

Sep. 3, 2003 (ZA) ..... 03/6869

(51) Int. Cl.
*A63B 69/36* (2006.01)

(52) U.S. Cl. ..... 473/165; 473/351; 473/588; 473/157

(58) Field of Classification Search ..... 473/157–165, 473/351, 588, 589, 595
See application file for complete search history.

(56) References Cited

U.S. PATENT DOCUMENTS

| | | | | | |
|---|---|---|---|---|---|
| 2,812,184 | A * | 11/1957 | McGee | 473/280 |
| 3,232,619 | A * | 2/1966 | Burk | 273/123 R |
| 3,332,688 | A * | 7/1967 | Gevertz | 473/265 |
| 3,540,735 | A * | 11/1970 | Miller | 473/267 |
| 3,870,308 | A * | 3/1975 | Reilly | 273/126 A |
| 5,226,660 | A * | 7/1993 | Curchod | 473/155 |
| 5,431,403 | A * | 7/1995 | Pelz | 473/160 |
| 5,478,612 | A * | 12/1995 | Hack et al. | 428/11 |
| D526,239 | S * | 8/2006 | Porter | D11/133 |
| 2004/0152529 | A1 * | 8/2004 | Chen | 473/159 |
| 2007/0202962 | A1 * | 8/2007 | Breaker et al. | 473/287 |

* cited by examiner

*Primary Examiner*—Mark S Graham
(74) *Attorney, Agent, or Firm*—Quarles & Brady; George E. Haas

(57) ABSTRACT

A golf putting practice device and ball is provided, wherein the ball has a flat end and a friction face which allow the putting practice ball to slide across the level putting surface of the putting practice device. The specific coefficient of friction provided by the friction face of the putting practice ball reduces the speed and the distance the putting practice ball travels over a putting surface of the putting practice device. This allows a golfer to practice a complete range of putts on a conveniently sized portable device.

12 Claims, 3 Drawing Sheets

PUTTING PRACTICE BALL AND DEVICE

BACKGROUND OF THE INVENTION

THIS invention relates to a golf putting practice ball and device.

Putting practice is traditionally considered by golfers to be of low priority. This is typically because golfers, when they do have time to practice, prefer to practice their long game or chipping. Also, good putting practice facilities are often out of the way and inconvenient to visit, while high quality greens are located at private clubs which are unavailable to non-members.

Putting practice is typically also tedious, in particular where long putts are practiced and the path to the hole gets cluttered with balls.

One of the other problems identified with putting practice is that putting surfaces are not always true. This may result in a golfer not being able to determine whether his or her putt was in fact aimed in the right direction. Alternatively, the golfer may not be able to determine whether the putt missed due to the slope or imperfections in the putting surface. It follows that a golfer practicing his or her putting typically wants to know that the shot was executed "on line" and that an error in the putting was one of judgment and not technique.

It is an object of the present invention to address at least some of the abovementioned problems.

SUMMARY OF THE INVENTION

According to a first aspect of the present invention there is provided a putting practice ball having a partially spherical body with a flat end enabling the ball, when struck, to slide across a surface.

Typically, the putting practice ball includes a first cavity in which is embedded a disc defining the flat end of the ball.

Preferably the disc defines a friction face of the ball. Alternatively a layer of material adhered to the disc defines the friction face of the ball.

The putting practice ball may include a second cavity used to change the center of gravity of the ball. Preferably a weight is located in the second cavity.

Typically the disc is manufactured from glass, textiles, a plastic, ceramic, polyurethane, leather, metal, wood or felt.

The layer of material may be manufactured from glass, textiles, a plastic, ceramic, polyurethane, leather, metal, wood or felt.

Advantageously the weight and the disc may form an integral body.

According to a second aspect of the invention there is provided a putting practice device comprising a putting portion having a level surface manufactured from glass, and a backswing metered portion.

Preferably the glass has been heat treated and is shatterproof.

The putting practice device may further include demarcation lines along its length which indicates equivalent traveling distances of a conventional golf ball on a conventional putting surface to the travel of a sliding ball on the putting portion of the putting practice device.

Typically, the putting practice device includes a leveling device.

The putting practice device may also include a catch-net attached to one end of the putting portion.

According to a third aspect of the invention there is provided a putting practice kit comprising:

a putting practice ball having a partially spherical body with a flat end enabling the ball, when struck, to slide; and a putting practice device having a level surface over which the putting practice ball slides when struck.

Typically, the putting practice device comprises a putting portion and a backswing metered portion.

Preferably at least the putting portion is manufactured from glass.

Advantageously the glass has been heat-treated and is shatterproof.

The putting practice device may further include demarcation lines along its length which indicates equivalent traveling distances of a conventional golf ball on a conventional putting surface to the travel of the putting practice ball on the putting practice device.

Typically the putting practice device further includes a leveling device.

Optionally, a catch-net is attached to one end of the putting practice device.

Typically, the putting practice ball includes a first cavity in which is embedded a disc defining the flat end of the ball.

Preferably the disc defines a friction face of the ball. Alternatively a layer of material adhered to the disc defines the friction face of the ball.

The putting practice ball may include a second cavity used to change the center of gravity of the ball. Preferably a weight is located in the second cavity.

Typically the disc is manufactured from glass, textiles, a plastic, ceramic, polyurethane, leather, metal, wood or felt.

The layer of material may be manufactured from glass, textiles, a plastic, ceramic, polyurethane, leather, metal, wood or felt.

Advantageously the weight and the disc may form an integral body.

According to a fourth aspect of the invention there is provided a method of manufacturing a putting practice ball including the steps of:

cutting a golf ball to provide a putting practice ball with a flat end; and securing a disc having a frictional face to the flat end of the ball thereby providing a putting practice ball which slides across a surface when struck with a putter.

Preferably the method includes the step of removing a portion of the core of the conventional golf ball adjacent to the flat end to define a first cavity for accommodating and embedding the disc.

Typically the method according includes the step of removing a portion of the core of the conventional golf ball adjacent to the first cavity to define a second cavity which is used to change the center of gravity of the putting practice ball.

The method further may include the step of receiving a weight in the second cavity of the putting practice ball thereby to further change the center of gravity of the ball.

DESCRIPTION OF PREFERRED EMBODIMENTS

Referring to the figures, a golf putting practice ball and putting device are shown. The ball has a flat end which restricts the movement of the ball to sliding.

Figure 1:
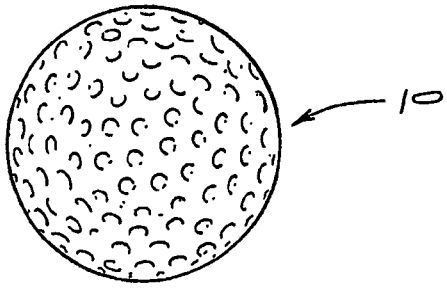
Fig.1 Prior Art
FIG. 1 shows a conventional golf ball.
Figure 2A:
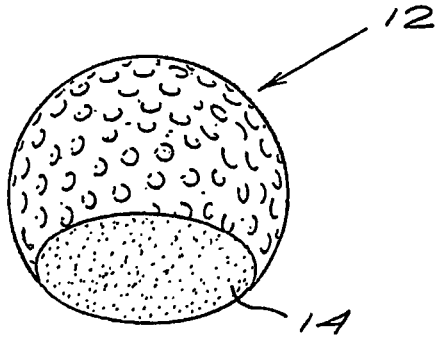
FIG. 2*a* shows a conventional golf ball with a piece of the ball cut off providing a flat end, thereby defining a sliding ball.
Figure 2B:
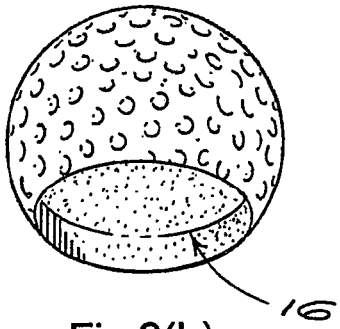
FIG. 2*b* shows a sliding ball with a first cavity.
Figure 2C:
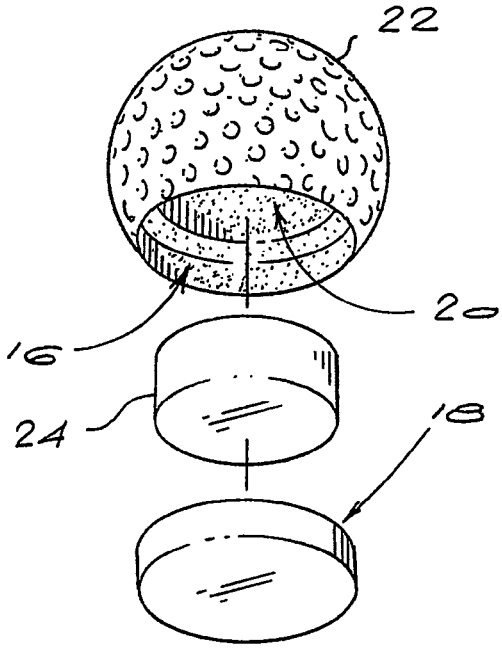
FIG. 2*c* shows an exploded view of the sliding ball with a first and second cavity for receiving a disc and weight respectively.
Figure 2D:
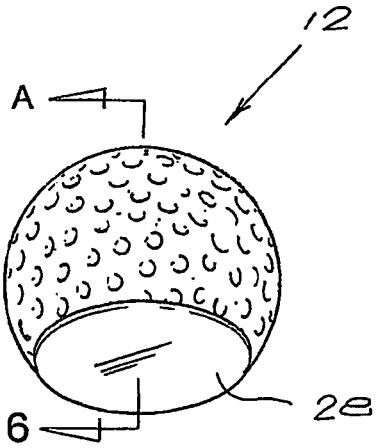
FIG. 2*d* shows the finished putting practice sliding ball with a friction face, and with an embedded weight and disc.
Figure 2E:
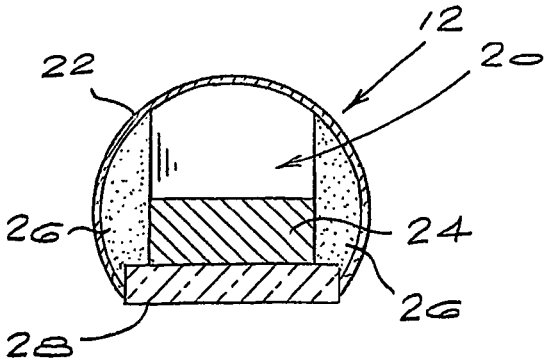
FIG. 2*e* shows a cross-sectional view along line A-A of FIG. 2*d*, clearly showing the second cavity with the embedded weight, the disc and the friction face.

Turning to FIG. 1 a conventional golf ball 10 is shown. This conventional ball is typically manufactured with a polyurethane composite, polyurethane derivative or imitation rubber inner core.

FIGS. 2*a* to 2*e* show the golf putting practice sliding ball 12 according to the invention in various steps of manufacture, with the conventional golf ball 10 being cut to provide the ball 12 with a flat end 14. Typically, the diameter of the flat end 14 is approximately 33 mm. It would be appreciated that the golf ball 10 can be cut at any cross-section, although the flat end 14 should preferably not be too close to the major cross-section of the ball thereby to ensure that the sliding ball 12 retains a partially spherical shape. This shape is necessary to provide a golfer practicing with this putting practice sliding ball 12 with a realistic experience when striking the ball with a putter.

The flat end 14 of the sliding ball 12 is hollowed out to define a first cavity 16 having a cylindrical shape in which to accommodate and embed a disc 18. Typically the diameter of the cavity 16 is the same as the diameter of the flat end 14 of the sliding ball 12, which in this preferred embodiment is 33 mm while the depth of the cavity 16 is between approximately 4 to 5 mm.

Above the first cavity 16 the core of the sliding ball is further removed and hollowed out so that the golf ball 12 defines a central second cavity 20 extending from the first cavity 16 to the ball cover 22. This second cavity 20 is used to change the center of gravity of the sliding ball 12, thereby enabling the ball 12 to slide across a surface when struck and not to fall over. The change in the center of gravity also ensures that the ball settles, after being struck, in a resting position with the flat end of the ball facing down towards the putting device. The second cavity 20 is at least partially filled with a weight 24 which conveniently may be a portion of the removed core. Alternatively, another type of material of different thickness and weight may be used as the weight 24. The second cavity 20 with the weight 24 located therein and with the top half of the second cavity 20 typically being left empty, i.e. filled with air, lowers the gravitational center of the sliding ball 12.

It will be appreciated that the conventional ball 10 may be cut or hollowed by any means, for example by milling, drilling or machining.

The disc 18 is now located in the first cavity 16 and secured to the remaining core 26 of the sliding ball as well as the weight 24 by adhesion or mechanical means such as a countersunk screw.

The outer surface of the disc 18 provides and defines a friction face 28 of the sliding ball. The disc 18 may be manufactured from any type of material that provides the sliding ball 12 with a friction face 28 having the required friction properties. Materials such as glass, textiles, acetal and other plastics, ceramic, polyurethane, leather, metal, wood, felt or melamine may be used. The weight of the materials used for the disc 18 is also taken into consideration when designing the sliding ball 12, as it also contributes to the location of the center of gravity of the ball.

In an alternative embodiment of the sliding ball the disc may be used only as a backing disc onto which a separate layer of material, which now defines the friction face, is secured by adhesion. As described above, the material used for the friction face is determined according to its qualities of friction. In this embodiment, the backing disc may be used as a weight to alter the location of the gravitational center of the ball. In this embodiment the second cavity and corresponding weight may be optional.

Irrespective of whether the friction face 28 is integral to the disc 18 or is a separate layer of material, the material from which the friction face 28 is manufactured determines a coefficient of friction for the sliding ball 12 with a putting surface. The speed of the sliding ball 12 and the distance the sliding ball 12 travels are dependent on this coefficient of friction. It would be appreciated that the friction face 28 could further be perforated, hollowed, dimpled, bristled or have a multitude of multi-shaped contact points, protrusions or concentric rings so as to achieve the desired properties of friction. It would further be appreciated that a lubricant applied to the friction face of the ball may be used to further influence the coefficient of friction of the sliding ball.

The coefficient of friction μ of a particular sliding ball can be determined with a simple equation derived from the conservation of energy principle.

$$\tfrac{1}{2}m.v^2 \text{ (initial movement of ball)} = \mu m.g.x \text{ (ball at rest)}$$

where ½ $m.v^2$ is the kinetic energy of the sliding ball as it starts to move

μm.g.x is the work done by the sliding ball in traveling a distance x m is the mass of the sliding ball v is the initial velocity of the sliding ball μ is the coefficient of friction of the sliding ball g is the gravitational force (10 $m.s^{-2}$)

x is the distance the ball travels in the horizontal plane before it comes to rest It would further be appreciated that further embodiments of the sliding ball 12 may be provided. In one such embodiment, the disc and the weight may be integrally formed. Also, the disc 18 may be secured to the flat end 14 of the golf ball without making use of any cavities. In such an embodiment the outer periphery of the disc 18 may extend beyond the outer periphery of the flat end 14.

The sliding ball may also comprise connection means to secure a mirror to the central upper portion of the ball. A male-female connector may be used as the connection means. The mirror is used to reflect the golfer's eye position at the time of putting, thereby to confirm that the golfer has aligned himself correctly above the ball.

Figure 3:
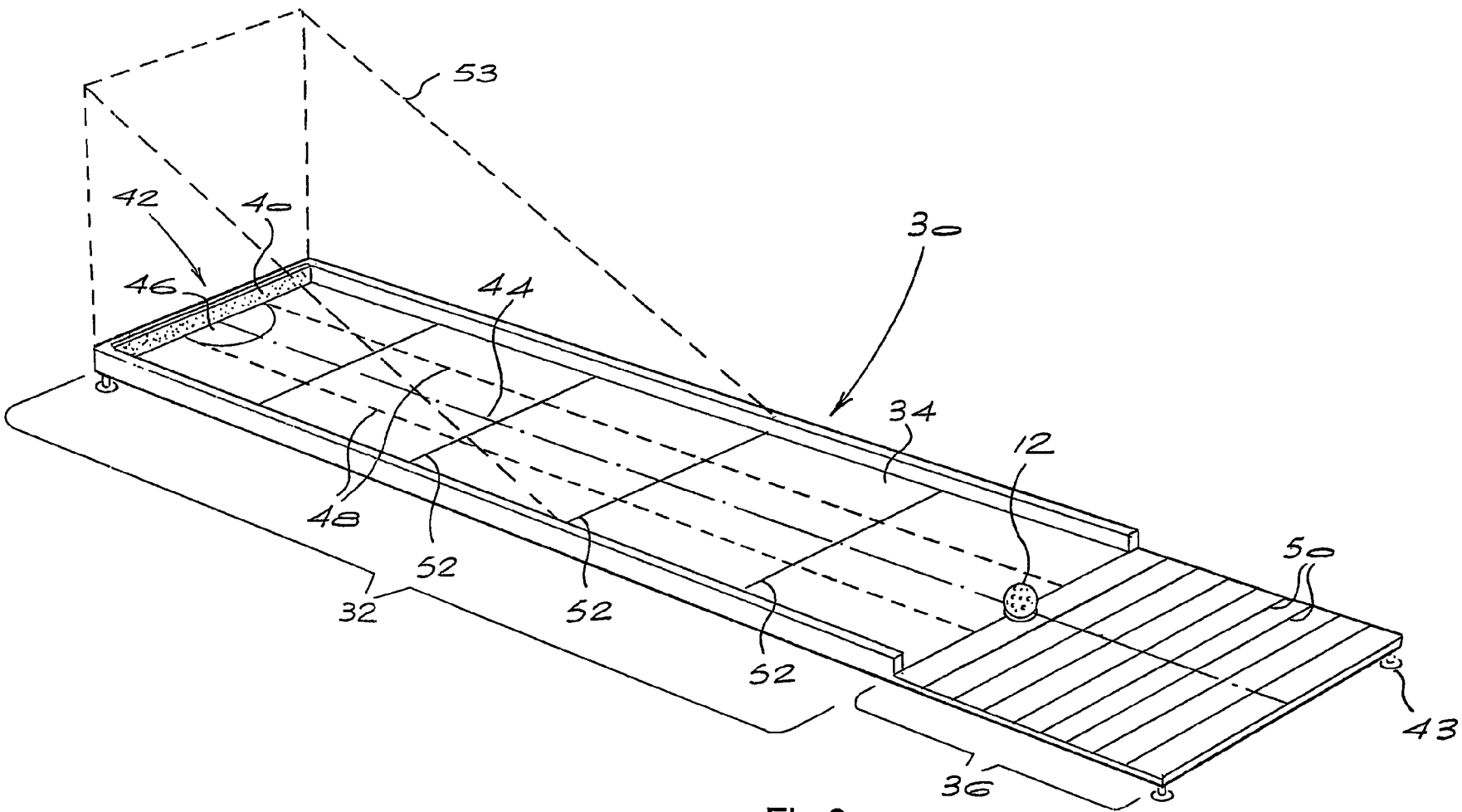
FIG. 3 shows a golf putting practice device having a putting portion and backswing measurement portion with demarcation lines on the putting portion and the backswing measurement portion.

Turning now to FIG. 3 there is provided a golf putting practice device 30 to be used with the putting practice sliding ball 12 as a putting practice kit. The putting device 30 has a putting portion 32 having a level putting surface 34 and optionally, a backswing measurement portion 36. Typically, the putting portion 32 and backswing measurement portion 36 are manufactured as separate panels. The putting portion 32 may comprise multiple panels to allow for easy dismantling, portability and convenient, packaging of the putting device 30. With multiple panels, it is necessary to ensure that the joint between adjacent panels does not compromise the level putting surface 34 defined by these panels.

An outer frame 38 is provided along the outer sides of the putting portion 32, with an end stop 40 in the form of a billiard cushion provided on the outer end 42 of the putting portion 32. The frame 38 ensures that the sliding ball 12 does not slide beyond the putting portion 32 of the putting device 30, while the billiard cushion 40 provides a surface from which the sliding ball bounces back. The outer frame 38 may be manufactured from any type of material, but for aesthetic reasons anodised aluminium or wood is preferred.

The putting portion 32 and backswing measurement portion 36 may be manufactured from any type of material such as plastic, glass, textiles, ceramic, metal, wood. However, glass has been used in the preferred embodiment of the invention. When used for the putting portion 32, a glass panel provides the putting device with the required level surface 34, especially where the glass is cast on a molten bed of tin. Glass is abrasion resistant and dimensionally very stable for easy and accurate engineering of the panels during manufacture.

A glass putting portion 32 provides a very consistent putting surface 34 and also provides the option to select multiple different surface finishes for the putting portion 32. The glass used for the putting portion 32 is typically heat treated to toughen it and to make it shatterproof, thereby providing a "safe" product which would not shatter when a person accidentally steps onto the putting device.

The putting device 30 is provided with leveling devices and slope creators. A typical leveling device used is a set of leveling screws, with each leveling screw being located on a corner of the putting device. The leveling screws 43 enable the comers of the device to be lowered or raised, thereby to accommodate any unevenness of the surface on which the putting device is set up. Screws may also be used as slope creators, i.e. to lift one end of the putting portion.

The putting portion 32 of the putting device 30 is marked with a central longitudinal line 44, one end of which terminates in a shape 46 representing a putting hole. Preferably the shape 46 is a circle or semi-circle. The central line 44 is used to indicate to the golfer the desired line of the putt. The backswing measurement portion 36 is located to the other end of the central line 44. At least one pair of additional longitudinal lines 48 run on either side of the central line 44 extending from the outer edges of the "putting hole", thereby providing the golfer with an indication of the allowed deviation of the sliding ball 12 when traveling towards the hole.

Where glass is used for the manufacture of the putting device 30, the putting portion markings may either be applied to the underside of the glass or alternatively, separate marking sheets with the mentioned demarcation applied to it may be placed beneath the glass panel or panels. These configurations ensure that the integrity of the upper surface of the glass, i.e. the putting surface, is maintained.

A slightly roughened putting surface is preferred as it assists in preventing a vacuum forming between the smooth surface of the friction face of the sliding ball and the upper surface of the putting portion 32. The roughened putting surface may further prevent the interference of small particles, such as dust and hair, with the sliding motion of the ball.

In the preferred embodiment of the putting device 30 the putting portion 32 has a length of 1.82 m, while the backswing measurement portion has a length of 0.55 m. The preferred width of the putting device is 0.225 m. It will be appreciated that these dimensions may vary, but it was found that the length and width of the preferred embodiment provided a compact, easily portable unit.

The backswing measurement portion 36 is demarcated with graduation lines or blocks 50 to provide the golfer practicing putting with the putting practice device 30 with a measuring tool to determine the length of his backswing when putting.

The putting device 30 also comprises demarcation lines 52 related to sliding balls with a particular friction coefficient. These demarcation lines are determined for a specific sliding ball using a graduated backswing metering device as explained, below. The demarcation lines may either be directly applied on the putting portion surface or it may alternatively be applied to a demarcation ruler which is placed beneath or on the putting portion 30.

Additionally, the putting practice device may include a catch-net 53 which may be attached to the outer end of the putting portion. This net assists the golfer when putt-chip shots are practiced.

Figure 4A:
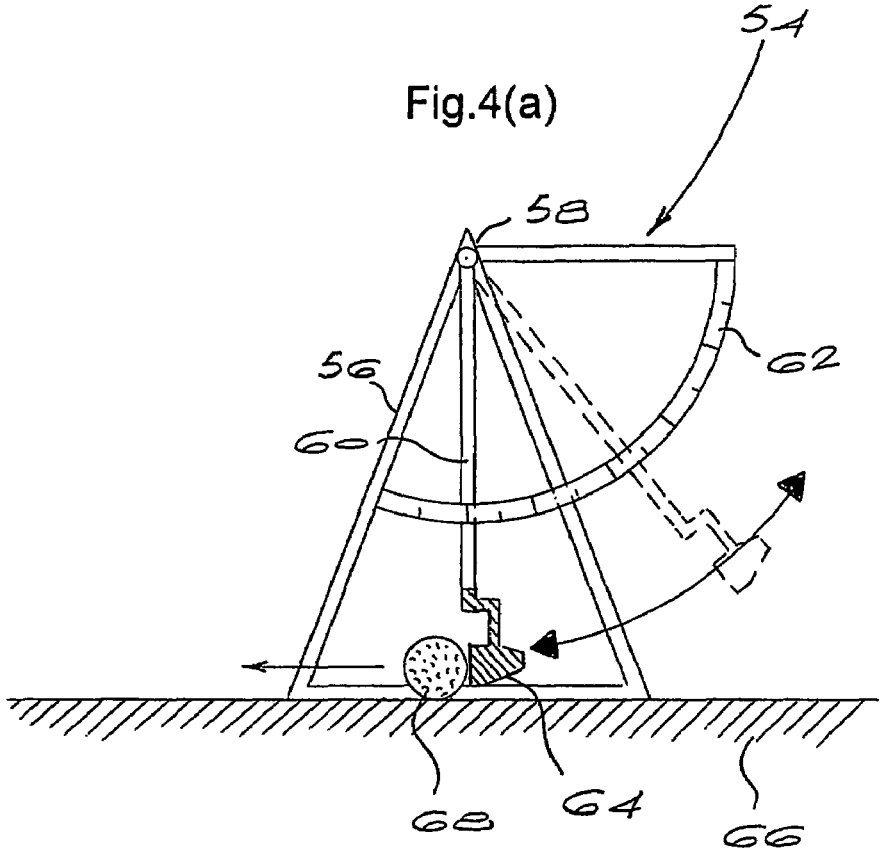
FIG. 4*a* shows a graduated backswing metering device used with a conventional golf ball on a conventional putting surface.
Figure 4B:
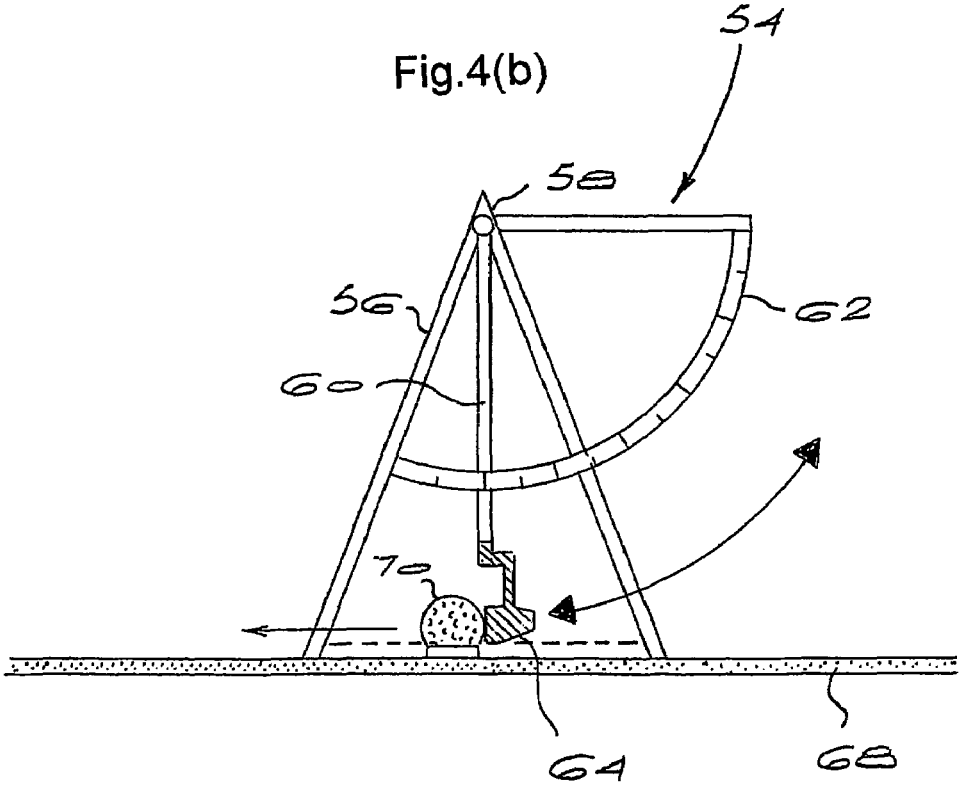
FIG. 4*b* shows a graduated backswing metering device used with the putting practice sliding ball on the golf putting practice device.

Turning now to FIG. 4*a* and FIG. 4*b* a graduated backswing metering device 54 is shown. This device 54 is used with the putting device 30 and the putting practice sliding ball 12 to measure the sliding motion of the putting practice ball on the putting surface at compared to the rolling motion of a conventional golf ball on a conventional putting surface. This information is used in the demarcation of the putting portion, in particular to demarcate the representative scale of distances the sliding ball travels on the putting surface.

The backswing metering device 54 has a support frame 56 with a pivot point 58 to which one end of a shaft 60 is pivotally connected or connectable. The shaft 60 hangs vertically downward in it's rest position. The backswing metering device further has a graduated backswing meter 62 which is used to measure a certain backswing of the shaft. The other end of the shaft terminates in a putting head 64 which is used to strike a golf ball.

The backswing metering device 54 is used by first setting it up on a conventional putting surface 66 such as a green with an average stimp of approximately 10. Once located on the green, a conventional golf bail 68 is placed in front of the putting head, with the shaft 60 in its rest position. To measure the distance the ball travels on the conventional putting surface, the shaft 60 is drawn back, away from its rest position, for a chosen angle which is recorded. The shaft 60 is now released, pivots through its rest position and strikes the ball with a force which is dependent on the chosen backswing of the shaft. The distance the ball has traveled on the conventional putting surface 66 is now recorded.

The same procedure is now repeated with the backswing metering device 54 being located on the putting device 68 and using the putting practice sliding ball 70. The backswing metering device 54 is aligned to strike the sliding ball 70 along the central line running to the putting hole. The shaft 60 is again drawn back from its rest position for the same chosen angle which was used during the test on the conventional putting surface 66. After the shaft 60 is released, it pivots through its rest position, striking the sliding ball 70, with the distance the sliding ball 70 travels on the putting surface being recorded. The sliding ball's traveling distance is the sum of the travel of the sliding ball 70 towards the billiard cushion and the travel of the sliding ball away from the billiard cushion. By comparing the equivalent distances the conventional golf ball and the putting practice sliding ball has traveled respectively, it is determined that a X meter putt on a conventional putting surface is equivalent to a Y meter putt on the putting device using the particular sliding ball. This comparison is indicated on the demarcation ruler and is used as a reference when a golfer uses the invention to practice his putting.

For example, in one putting practice sliding ball prototype felt was used as the friction face of the sliding ball. The diameter of the friction face and disc was approximately 33 mm with the disc having a thickness of approximately 5 mm. The second cavity extending from the first cavity to the ball cover had a diameter of 25 mm. The weight used in this prototype was a 12 to 15 mm cylindrical disc cut from the core removed to form the second cavity. The prototype had an approximate weight of 33 to 35 g. The prototype traveled 1.8 m on the preferred embodiment putting portion of the putting practice device, as compared to a 7 m putt on a conventional putting surface.

In a second putting practice sliding ball prototype melamine was used as the friction face of the sliding ball. With similar dimensions as that of the first prototype, the prototype traveled 0.75 times the distance a conventional golf ball would travel on a conventional putting surface. The second prototype provides a golfer with a better indication of the speed of a conventional golf ball, while the first prototype provides the golfer with a good feel for how to use the putting practice device.

The invention accordingly provides a golf putting practice device and sliding ball which, when used correctly, would improve a golfer's putting technique, accuracy and the golfer's assessment of distance.

The invention allows a golfer to putt the sliding ball, as a conventional golf ball would be putted, without affecting the accuracy of the putt. The friction between the putting surface of the putting portion and the friction face of the sliding ball reduces the distance the sliding ball travels by a factor which is calculated as described and which is shown either on the putting portion or on a demarcation ruler placed on the putting portion. The level putting device and the level friction surface ensures that the sliding ball travels in the true direction in which it was struck. By proportionately reducing the putting distances, the invention allows the golfer to practice a complete range of putts on a conveniently sized portable device which can be placed in an office, or in the comfort of the golfer's home.

The invention claimed is:

1. A putting practice kit comprising:

a putting practice ball having a partially spherical body with a flat end enabling the ball, when struck, to slide; and a putting practice device comprising a putting portion having a level surface over which the putting practice ball slides when struck and a backswing metered portion which is demarcated with graduation lines or blocks to provide a golfer with a measuring tool to determine the length of the golfer's backswing when putting, wherein the ball further includes a first cavity in which is embedded a disc defining the flat end of the ball which disc has a friction face with a predetermined coefficient of friction to reduce the speed and distance the ball travels over the level surface of the putting portion of the practice device.

2. A putting practice kit according to claim 1 wherein at least the putting portion is manufactured from glass.

3. A putting practice kit according to claim 2 wherein the glass has been heat treated and is shatterproof.

4. A putting practice kit according to claim 1 wherein the putting portion further includes demarcation lines along its length which indicates equivalent traveling distances of a conventional golf ball on a conventional putting surface to the travel of the putting practice ball on the putting practice device.

5. A putting practice kit according to claim 1 wherein the putting practice device further includes a leveling device.

6. A putting practice kit according to claim 1 including a catch-net attached to one end of the putting practice device.

7. A putting practice kit according to claim 1 wherein a layer of material adhered to the disc defines the friction face of the putting practice ball.

8. A putting practice kit according to claim 1 wherein the putting practice ball includes a second cavity used to change the center of gravity of the putting practice ball.

9. A putting practice kit according to claim 8 including a weight located in the second cavity.

10. A putting practice kit according to claim 1 wherein the disc is manufactured from glass, textiles, a plastic, ceramic, polyurethane, leather, metal, wood or felt.

11. A putting practice kit according to claim 7 wherein the layer of material is manufactured from glass, textiles, a plastic, ceramic, polyurethane, leather, metal, wood or felt.

12. A putting practice kit according to claim 9 wherein the weight and the disc form an integral body.

* * * * *